US009186638B2

(12) United States Patent
Claussen et al.

(10) Patent No.: US 9,186,638 B2
(45) Date of Patent: Nov. 17, 2015

(54) MICROFLUIDIC STRUCTURE

(75) Inventors: Jan Claussen, Wiesbaden (DE); Malte Weniger, Hofheim-Wildsachsen (DE)

(73) Assignee: FRAUNHOFER-GELLSCHAFT ZUR FÖRDERUNG DER ANGEWANDTEN FORSCHUNG E.V., Müchen (DE)

( * ) Notice: Subject to any disclaimer, the term of this patent is extended or adjusted under 35 U.S.C. 154(b) by 508 days.

(21) Appl. No.: 12/924,788

(22) Filed: Oct. 5, 2010

(65) Prior Publication Data

US 2011/0081275 A1 Apr. 7, 2011

(30) Foreign Application Priority Data

Oct. 6, 2009 (DE) ..... 10 2009 048 378

(51) Int. Cl.
*B01L 3/00* (2006.01)
*B01F 13/00* (2006.01)
(Continued)

(52) U.S. Cl.
CPC ..... *B01F 13/0064* (2013.01); *B01F 5/0471* (2013.01); *B01F 5/0646* (2013.01);
(Continued)

(58) Field of Classification Search
CPC ..... B01F 13/0064; B01F 13/0084; B01F 13/0086; B01F 5/0471; B01F 5/0646; B01F 5/0654; B01L 2200/027; B01L 2200/026; B01L 2300/0867; B01L 2300/0861; B01L 2300/161; B01L 2400/0406
USPC ..... 422/68.1, 502, 504, 507, 537
See application file for complete search history.

(56) References Cited

U.S. PATENT DOCUMENTS 6,591,852 B1 * 7/2003 McNeely et al. ..... 137/14
7,247,274 B1 * 7/2007 Chow ..... 422/504
(Continued)

FOREIGN PATENT DOCUMENTS

DE 100 13 311 A1 9/2001
DE 10 2008 002 674 B3 5/2010
(Continued)

OTHER PUBLICATIONS

Munchow, G. et al., Automated chip-based device for simple and fast nucleic . . . , Expert Rev. Mol. Diagn., vol. 5, (4), 2005 Future Drugs Ltd., pp. 613-620.
(Continued)

*Primary Examiner* — Lyle Alexander
*Assistant Examiner* — Jennifer Wecker
(74) *Attorney, Agent, or Firm* — Hudak, Shunk & Farine Co. LPA

(57) ABSTRACT

Pressure-operable microfluidic structure for the bubble-free combining of two liquid volumes with a fluid chamber that has a feed opening, as well as an inlet and outlet channel emerging into the fluid chamber, wherein the fluid chamber has a cross section that broadens out relative to the inlet channel in the direction of flow from the inlet to the outlet channel and is designed, thanks to the broadened cross section, to broaden a first liquid volume that is essentially pressure-driven and conducted through the inlet channel and through the fluid chamber to a cross section at least approximately corresponding to the full cross section of the fluid chamber, while the fluid chamber has a holding position and is configured so that a second liquid volume, placed in the fluid chamber through the feed opening, can be held in the region of the holding position and the second liquid volume when the first liquid volume is moved through by pressure can be taken up by the latter and delivered as a combined liquid volume through the fluid chamber and into the outlet channel.

18 Claims, 8 Drawing Sheets

(51) Int. Cl.
*B01F 5/04* (2006.01)
*B01F 5/06* (2006.01)
*G01N 1/00* (2006.01)

(52) U.S. Cl.
CPC ..... *B01F5/0654* (2013.01); *B01F 13/0084* (2013.01); *B01F 13/0086* (2013.01); *B01L 3/502715* (2013.01); *B01L 3/5027* (2013.01); *B01L 3/502746* (2013.01); *B01L 2200/026* (2013.01); *B01L 2200/027* (2013.01); *B01L 2300/0861* (2013.01); *B01L 2300/0867* (2013.01); *B01L 2300/161* (2013.01); *B01L 2400/043* (2013.01); *B01L 2400/0406* (2013.01); *B01L 2400/0487* (2013.01); *B01L 2400/086* (2013.01)

(56) References Cited

U.S. PATENT DOCUMENTS

| | | | | |
|---|---|---|---|---|
| 7,691,328 | B2 * | 4/2010 | Horiike et al. | 422/72 |
| 2006/0216195 | A1 * | 9/2006 | Blankenstein et al. | 422/57 |
| 2008/0153152 | A1 * | 6/2008 | Wakabayashi et al. | 435/287.2 |
| 2008/0161769 | A1 * | 7/2008 | Howell et al. | 604/403 |
| 2010/0044376 | A1 * | 2/2010 | Engstrom | 220/212 |
| 2010/0233824 | A1 * | 9/2010 | Verhoeckx et al. | 436/501 |
| 2010/0311186 | A1 * | 12/2010 | Gregory et al. | 436/501 |
| 2011/0207619 | A1 * | 8/2011 | Ehben et al. | 506/9 |
| 2012/0031176 | A1 * | 2/2012 | Naessens et al. | 73/61.59 |

FOREIGN PATENT DOCUMENTS

| | | | |
|---|---|---|---|
| EP | 1 932 593 | A1 | 6/2008 |
| EP | 2311565 | A1 * | 4/2011 |
| WO | WO 2004/012864 | A1 | 2/2004 |
| WO | WO 2008/036997 | A1 | 4/2008 |

OTHER PUBLICATIONS

Drese, K., et al., Sample Preparation in Lab-on-a-Chip Systems, Medical Device Technology, 2007, 3 pages.

* cited by examiner

MICROFLUIDIC STRUCTURE

FIELD OF THE INVENTION

The invention indicates a microfluidic structure for the combining of liquid volumes, as well as a microfluidic system with such a microfluidic structure.

BACKGROUND OF THE INVENTION

Microfluidic systems were already the subject of biotechnology research and development in past years and are being used increasingly in the form of so-called lab-on-a-chip systems etc., also for medical diagnosis in point-of-care products. The terms microfluidic system and lab-on-a-chip are used here as synonyms. On these microfluidic chip systems, protocols previously worked out in the laboratory are converted as completely as possible into a microfluidic structure on the lab-on-a-chip, so that the protocols are largely automated and take place with the least possible manual intervention. The chip systems are generally used with operator devices, while the operator devices are outfitted with a holder for the chip as well as electrical, fluidic and actuator interfaces for the chip, if needed.

The microfluidic systems contain various microfluidic structures with size dimensions in the micrometer range, while individual microfluidic structures, especially fluid chambers or fluid reservoirs, can also have larger cross sections in the millimeter range. Often the microfluidic systems are formed by a base plate in which channels and depressions are fashioned, and a cover foil enclosing the channels and depressions. The base plates are molded from plastic by injection molding or embossing and the cover foils are joined fluid-tight to the base plates by gluing or welding. Modular microfluidic systems made of several planar and/or blocklike microfluidic modules are also known, such as the publication of Drese, K.; von Germar, F.; Ritzi, M.: "Sample preparation in Lab-on-a-Chip systems—Combining modules to create a fully integrated system", in: Medical Device Technology 18 (2007) 1, 42-47. These individual modules are coupled together by suitable connections so as to realize various process pathways, depending on the stated goal.

An often occurring process operation within microfluidic systems is the combining of different fluid volumes. Various solutions already exist for this.

The publication of Götz Münchow, Dalibor Dadic, Frank Doffing, Steffen Hardt, Klaus-Stefan Drese, "Automated chip-based device for simple and fast nucleic acid amplification", in Expert Rev. Mol. Diagn. 5 (4), (2005), indicates in FIG. 7 and the accompanying description (page 616, left column) a microfluidic structure for the combining of two liquid volumes. The Y-shaped structure for this has two inlet lines coming together at an acute angle, which are joined in a channel. In the region where the inlet lines discharge into the channel the inlet lines are narrowed in cross section. The liquids being combined are introduced into the inlet lines and move by capillary forces as far as the narrowed points of the inlet lines, but halt at the end of these points before entering the channel with the broader cross section. Only when a pressure pulse is applied to at least one inlet line can the capillary force preventing the liquid from moving into the channel be overcome and trigger the combining of the liquids in the channel.

In European patent application EP 1 932 593 A1 a microfluidic structure is indicated for the combining of liquids, in which an inlet line for a first fluid empties into a channel. The first liquid is kept ready in a reservoir joined to the inlet line and open to the surroundings and it flows by capillary forces up to the point where the inlet line empties into the channel. The first liquid is taken up by a second liquid, which is also carried in the channel by capillary forces. Important to this type of fluid control is the correct matching of the capillary forces operating in channel, feed opening and reservoir by structure sizes, as well as surface quality. Furthermore, a ventilation of the reservoir is required.

By microfluidic structures and systems according to the indicated invention are meant those systems and structures whose fluid channels have cross section dimension with magnitudes in at least one direction perpendicular to the direction of flow in the range of 10 μm to 2000 μm and especially preferably in the range of 25 μm to 1500 μm. The liquid volumes stored and delivered in these microfluidic systems and structures are in the nanoliter to several-digit microliter range in the case of small volumes, and in the milliliter range in the case of larger volumes.

Pressure-operable or pressure-operated in the sense of the invention's microfluidic systems or structures means that liquid volumes in the microfluidic systems or structures of the invention are driven or can be driven by a delivery pressure acting from outside the microfluidic system or microfluidic structure, such as one generated by a syringe pump. A passive drive, especially a drive acting solely through capillary forces, is not possible or specified for the microfluidic systems or structures of the invention since the cross sectional dimensions of the microfluidic structures in the microfluidic systems of the invention are so large, at least in sections, or the surface textures of the microfluidic structures are configured such that not enough capillary pressure is formed there for reliable delivery of liquid by the microfluidic systems.

On the other hand, capillary driving of the liquids is also possible in individual sections of the microfluidic systems of the invention.

In alternative embodiments; a driving of liquid volumes by making use of magnetorheological liquids or ferrofluids can also be used in the microfluidic systems or structures of the invention. In this case, plugs of a magnetorheological liquid or a ferrofluid are placed in the direction of flow upstream or downstream of the liquid volumes being delivered in the channels or structures of the microfluidic system. A driving of the plugs and the liquid volumes connected with them is done by magnets moved parallel to the fluid structures. In another variant of this type of propulsion, a plug of a magnetorheological liquid or a ferrofluid is moved in a channel section of larger cross section and produces by its movements a delivery pressure in a channel of smaller cross section, fluidically connected to the former channel. Thanks to the different cross sectional sizes of the channels, a large delivery power can be achieved in the channels of smaller cross section with short displacements of the magnets. In the case of an equally possible reversed relationship of cross sectional sizes, a very position and/or pressure-precise delivery can be achieved in the channels of smaller cross section.

SUMMARY OF THE INVENTION

The problem on which the invention is based is to indicate a simple microfluidic structure for the bubble-free combining of liquid volumes and a lab-on-a-chip with such a microfluidic structure.

The problem is solved by a microfluidic structure for the bubble-free combining of two liquid volumes comprising a fluid chamber, which has a feed opening, as well as an inlet and outlet channel emerging into the fluid chamber, wherein the fluid chamber has a cross section that broadens out relative to the inlet channel in a direction of flow from the inlet to the outlet channel and is designed, thanks to the broadened cross section, to broaden a first liquid volume that is essentially pressure-driven and conducted through the inlet channel and through the fluid chamber to a cross section at least approximately corresponding to the full cross section of the fluid chamber, wherein the fluid chamber has a holding position and is designed such that a second liquid volume, placed in the fluid chamber through the feed opening, can be held in the region of the holding position and wherein the second liquid volume when the first liquid volume is moved through by pressure can be taken up by the latter and delivered as a combined liquid volume through the fluid chamber and into the outlet channel and a lab-on-a-chip comprising at least one microfluidic structure wherein the lab-on-chip additionally has several other channels, chambers and/or reservoirs.

The pressure-operable microfluidic structure of the invention for the bubble-free combining of a first and a second liquid volume has a fluid chamber with a feed opening, as well as an inlet and outlet channel emerging into the fluid chamber.

The fluid chamber has a cross section that broadens out relative to the inlet channel in the direction of flow from the inlet to the outlet channel and is designed, thanks to the broadened cross section, to broaden a first liquid volume that is essentially pressure-driven and conducted through the inlet channel and through the fluid chamber to a cross section at least approximately corresponding to the full cross section of the fluid chamber, i.e., at least 75%, preferably 95% of the cross section area, during its entire flow through the fluid chamber.

The fluid chamber has a holding position for a second liquid volume. The holding position is configured so that a second liquid volume, placed in the fluid chamber through the feed opening, can be held in the region of the holding position so that only a portion of the fluid chamber cross section is filled up, and the second liquid volume when the first liquid volume is moved through by pressure is taken up by the latter and delivered as a combined liquid volume through the fluid chamber and into the outlet channel.

In the case of small second liquid volumes, the contact surfaces forming between the small second liquid volume and the fluid chamber are already enough to serve as holding structures to form a limited holding position, especially contact surfaces with the bottom, top, and one wall surface of the fluid chamber in the region of the feed opening. Preferably, the holding position for the second liquid volume is formed in a region of the fluid chamber with at least one at least partly curved and/or at least partly trough-shaped wall, bottom and/or top surface as a holding structure. The curvature and/or trough increases the contact surface between the second liquid volume and fluid chamber and larger holding forces are produced. This is preferably a curvature or trough of a surface formed locally in the region of the holding position.

A microfluidic structure according to the invention enables a secure operation, scarcely prone to errors, and an economical fabrication, thanks to the simple, undemanding configuration. The inclusion of air bubbles in the combined liquid volume is securely prevented with a simpler manner of combining the liquid volumes in the microfluidic structure.

The surfaces of the channels and the fluid chamber of the microfluidic structure and/or the lab-on-a-chip of the invention can be designed to be wettable through the choice of material and/or manufacturing process. However, coatings or other processes which render the surface wettable are also possible. Wettable means, in the case of a microfluidic structure for aqueous solutions, choosing a pronounced hydrophilic surface with a contact angle of more than 0° to less than 90°, or preferably with a contact angle of 5° to 70°. In the case of very low contact angle, there is a risk of the liquid creeping along the surfaces and channels. In the case of microfluidic structures for organic, nonpolar liquids, pronounced lipophilic surfaces are preferred.

Thanks to the surfaces of the microfluidic structure according to the invention that have been made wettable in the mentioned way, the first liquid upon flowing through the fluid chamber is stretched in contact with the wall, bottom and top surfaces across the full cross section of the fluid chamber, and no possibly gas-permeable intermediate space is formed between first liquid and wall, bottom and top surfaces as it flows through the fluid chamber.

The hydrophilic or lipophilic treatment can be done in known fashion by a dipping method, as described in DE 100 13 311 C2, or by a coating process. For example, polycarbonate, a slightly hydrophobic material, can be made hydrophilic by an oxygen plasma treatment on the surface.

The polymer material, in which the microfluidic structure of the invention or the lab-on-a-chip is preferably made, is preferably an injection-moldable or (hot) stamped polymer, especially preferably a thermoplastic or an elastic thermoplastic. One can also use one or more of the following materials: acrylate, polymethylacrylate, polymethylmethacrylate, polycarbonate, polystyrene, polyimide, cycloolefin copolymer (COC), cycloolefin polymer (COP), polyurethane, epoxy resin, halogenated acrylate, deuterated polysiloxane, PDMS, fluorinated polyimide, polyetherimide, perfluorcyclobutane, perfluorvinylether copolymer (Teflon AF), perfluorvinylether cyclopolymer (CYTOP), polytetrafluorethylene (PTFE), fluorinated polyarylether sulfide (FRAESI), inorganic polymer glass, polymethylmethacrylate copolymer (P2ANS).

In further embodiments, the microfluidic structure and the lab-on-a-chip according to the invention can also be made from glass, silicon, metal and/or ceramic, depending on the application, and a combination of various of the aforementioned materials can also be used, such as a glass or silicon base plate with channels and chambers worked into it can be covered by polymer foils.

In one preferred embodiment of the invention, the fluid chamber has a cross section widened with respect to the inlet channel by not more than 5 times, especially preferably by not more than 2.5 times. This limited broadening of the fluid chamber relative to the inlet channel ensures that the first liquid volume is broadened to at least approximately the full cross section of the fluid chamber as it flows through the fluid chamber under pressure.

Also the preferred embodiment of the broadening of the inlet channel to the cross section of the fluid chamber in the form of a steady widening, preferably a curvelike widening, without edges or corners, supports the broadening of the first liquid volume to the at least approximately full cross section of the fluid chamber during the entire flow through the fluid chamber.

The fluid chamber has a preferably oblong shape, i.e., its length in the flow direction is greater than its largest cross section dimension of the fluid chamber, especially preferably it is longer by a multiple of the largest cross sectional dimension of the fluid chamber. The inlet and/or outlet channel each emerge into the oblong fluid chamber at a short side or point.

The fluid chamber can also be asymmetrical in the flow direction with broadening only at one end, i.e., for example, with the shape of a triangle, a trapezium or a circular segment in top view, while the inlet and outlet channels each lie in the region of the ends of the longest side or the ends of the chord of the circle.

In further advantageous embodiments of the microfluidic structure of the invention, other structures can be provided in the fluid chamber to support the bringing together of the liquid volumes. For example, in the region where the inlet channel emerges into the fluid chamber there can be a dent curved inwardly into the fluid chamber at one end. A liquid volume flowing into the fluid chamber through the inlet channel will first be conducted only along one wall surface of the fluid chamber and only be widened to the at least approximately full cross section of the fluid chamber downstream from the structure that supports the bringing together of liquids. This configuration of the fluid chamber supports the widening of the first liquid volume to the at least approximately full cross section of the fluid chamber without there being a breakthrough of a delivery gas, for example.

In the case of asymmetrically shaped fluid chambers, the first liquid volume is conducted in this fashion from the wall surface near the inlet channel in the flow direction along the longest side or along the circle chord in a streamline lying centrally in the fluid chamber, so that a less pronounced widening of the liquid volume at both ends can occur along the central flow direction after the structures supporting the bringing together of liquids.

The feed opening and/or holding position for the second liquid volume are preferably arranged off-center in the fluid chamber, i.e., away from a central streamline extending from the inlet channel through the fluid chamber to the outlet channel. In the case of an asymmetrical configuration of the fluid chamber, the feed opening and/or holding position can be arranged in the region of the protrusion at one end of the fluid chamber, likewise away from the central streamline from the inlet to the outlet channel through the fluid chamber.

This configuration prevents a gas flowing through the microfluidic structure from entraining a second liquid volume already placed in the microfluidic structure before the first liquid volume gets to the fluid chamber.

In one preferred embodiment of the invention the feed opening can be closed. With a closed feed opening, the pressure difference prevailing in the pressure-operated propulsion of the liquids can be kept at a lower level and an operation at a pressure lower than the surroundings is possible. The feed opening is designed preferably so that it closes automatically, for example, by placing a septum or an elastic cover foil on it. Sample liquids can therefore be applied as the second liquid volume, without a risk of the sample liquids escaping from the microfluidic structure of the invention. A contamination of the inner spaces of the microfluidic structure of the invention can also be prevented in this way.

In another embodiment, the feed opening can also be designed to be closed by a sealing element which can move relative to the feed opening. The sealing element in this embodiment is part of the microfluidic structure. In event of using a movable sealing element, the sealing element preferably has engaging elements which can be engaged during operation in an operator device by corresponding actuators of the operator device.

Also a configuration of the feed opening that is opened and closed via an operator device is provided in a further preferred embodiment of the microfluidic structure of the invention. For this, the feed opening has a sealing surface, for example, which is in tight fluidic connection with a closable fluid line of an operator device when the microfluidic structure is operating in an operator device, or it can be opened and closed by an active sealing element of the operator device.

The aperture of the feed opening is preferably small, i.e., smaller than 1/20 and especially preferably smaller than 1/100 of the largest cross sectional area of the fluid chamber in the flow direction from the inlet channel to the outlet channel. A small aperture of the feed opening reduces the danger of contamination. If it is not arranged to close the feed opening during operation of the microfluidic structure, there is furthermore no risk of escape of the liquids being delivered in the microfluidic structure when the aperture of the feed opening is small.

The feed opening in another preferred embodiment can also be configured as a channel emerging into the fluid chamber. To assure an unhindered flow through the fluid chamber during operation of the microfluidic structure from the inlet channel to the outlet channel, the cross section of the feed openings in a preferred embodiment is very small in relation to the cross sectional area of the fluid chamber transverse to the direction of flow, preferably less than 1/20. The feed opening can also be made to close in this embodiment.

The fluid chamber can also have several feed openings for adding several second liquid volumes. In this way, more than just two liquid volumes can be combined with each other or the feed amount can also be divided among several feed openings and holding positions.

Preferably one holding position is arranged in the fluid chamber for each feed opening. The second liquid volumes added in this way are only brought together with each other when a first liquid volume has been conducted through the fluid chamber and picks up the second liquid volumes one after another.

In further embodiments, holding structures are configured in the region of the holding positions in addition to the aforementioned structures or also as the sole holding structure. These holding structures, alone or in variously configured combinations of alternative holding structures, assure the secure positioning and fixation of small to rather large second liquid volumes in the microfluidic structure of the invention.

The holding position can have, as holding structures for this, special surface structures such as recesses, surface textures, or one or more steles. For example, changes in the surface energies (contact angles) can be used for localization of the stored drops. Preferably, the contact angle of the second liquid volume with the surface of the holding structure is greater than 0° and less than 90°, especially preferably greater than 5° and less than 70°.

Structures for secure positioning of the second liquid volume at the holding position comprise, in a further embodiment, especially two-sided structures, such as steles on either side of the feed opening in the fluid chamber, since in this way the holding position for the second liquid volume is configured between these steles and additional holding surfaces for the second liquid volume for the fluid chamber can be formed.

Furthermore, different heights of the fluid chamber can be used for secure positioning of the second liquid volume. For this, the fluid chamber is configured lower in the region of the holding position than in the rest of the fluid chamber, so that the second liquid volume has a contact with bottom, top and side wall of the fluid chamber in the region of the holding position.

In further embodiments, surface roughness of the walls of the fluid chamber is used as holding structures in the region of the holding position to support hysteresis effects, in order to support a secure positioning of the second liquid volume.

The holding position occupies only a portion of the fluid chamber's cross section, so that the entire cross section of the fluid chamber is not blocked. The limiting of the holding position to partial regions of the fluid chamber can be supported by the corresponding local limited configuration of holding structures in the region of the holding position.

In microfluidic systems consisting of a base plate with cover foil, the so-called lab-on-a-chip, the feed openings are preferably configured as a hole above the fluid chamber in a cover foil. In a further embodiment, however, the feed openings can also be fashioned as openings in the bottom and/or side surfaces of the fluid chamber in the base plate.

In another embodiment of the microfluidic structure of the invention, several fluid chambers with feed openings are arranged one behind another. This embodiment enables the sequential combining of liquids. Thus, reactions can be carried out in succession.

The microfluidic structure of the invention in other embodiments can also have additional elements which support a widening and flowing through the fluid chamber, for example, to almost the full cross section of the fluid chamber, possibly with total wetting of the wall, bottom and top surface of the fluid chamber in the manner of the invention, for example, steady narrowings of the cross section on one or more sides at the transition from the inlet channel to the fluid chamber.

In another embodiment of the invention, after the combining of the liquid volumes and their issuing through the outlet channel it is also possible to reverse the direction of flow of the combined liquid volumes.

The invention also comprises a lab-on-a-chip with at least one microfluidic structure according to one of the indicated embodiments, wherein the lab-on-chip additionally has several other channels, chambers and/or reservoirs. The lab-on-a-chip of the invention is therefore suitable for carrying out several consecutive process steps including the bubble-free combining of two liquid volumes in the microfluidic structure of the invention.

Such a lab-on-a-chip can be filled already with certain chemicals in some chambers and/or reservoirs during the course of its manufacture. In operation, the sample being processed is then placed through the feed opening into the lab-on-a-chip and a process chain is worked off through a suitable set of actuators in the operator device, making use of the chemicals already stored on the chip.

The lab-on-a-chip can have the microfluidic structures of the invention once or more times in a consecutive or parallel arrangement in the direction of flow of the fluids, so that sequential or parallel combining of liquid volumes can also occur. In the case of the sequential arrangement, reaction sequences can be worked off in the lab-on-a-chip. In a parallel arrangement, process chains running in parallel can be worked off on a single chip.

The invention is not limited to the above described embodiments and the following sample embodiments, but rather also covers new combinations of features, formed from the basic notions of the invention as indicated in claim 1 or claim 18, and individual features and combinations of features of the preferred embodiments and the sample embodiments.

In the following sample embodiments, for the most part only the microfluidic structures of the invention are depicted, fashioned as trenches and depressions in a base plate and covered with a foil. However, the microfluidic structure of the invention constitutes only one part of the structures in the overall system, i.e., besides the microfluidic structure of the invention other elements are also contained in these systems, such as channels, chambers, reservoirs, actuators, etc., and they interact structurally or functionally with each other.

BRIEF DESCRIPTION OF THE DRAWINGS

Individual sample embodiments are presented hereafter.

DETAILED DESCRIPTION OF THE INVENTION

In the figures, liquid boundary surfaces of the liquid volumes 41, 42, 43, 141 are shown in the form of broken lines. In the sample embodiment with a figure in top view, the cover foil is not indicated. In these figures, only the base plate with the contours of the channels and chambers is shown. The direction of flow of the fluids is indicated by black arrows.

Figure 1:
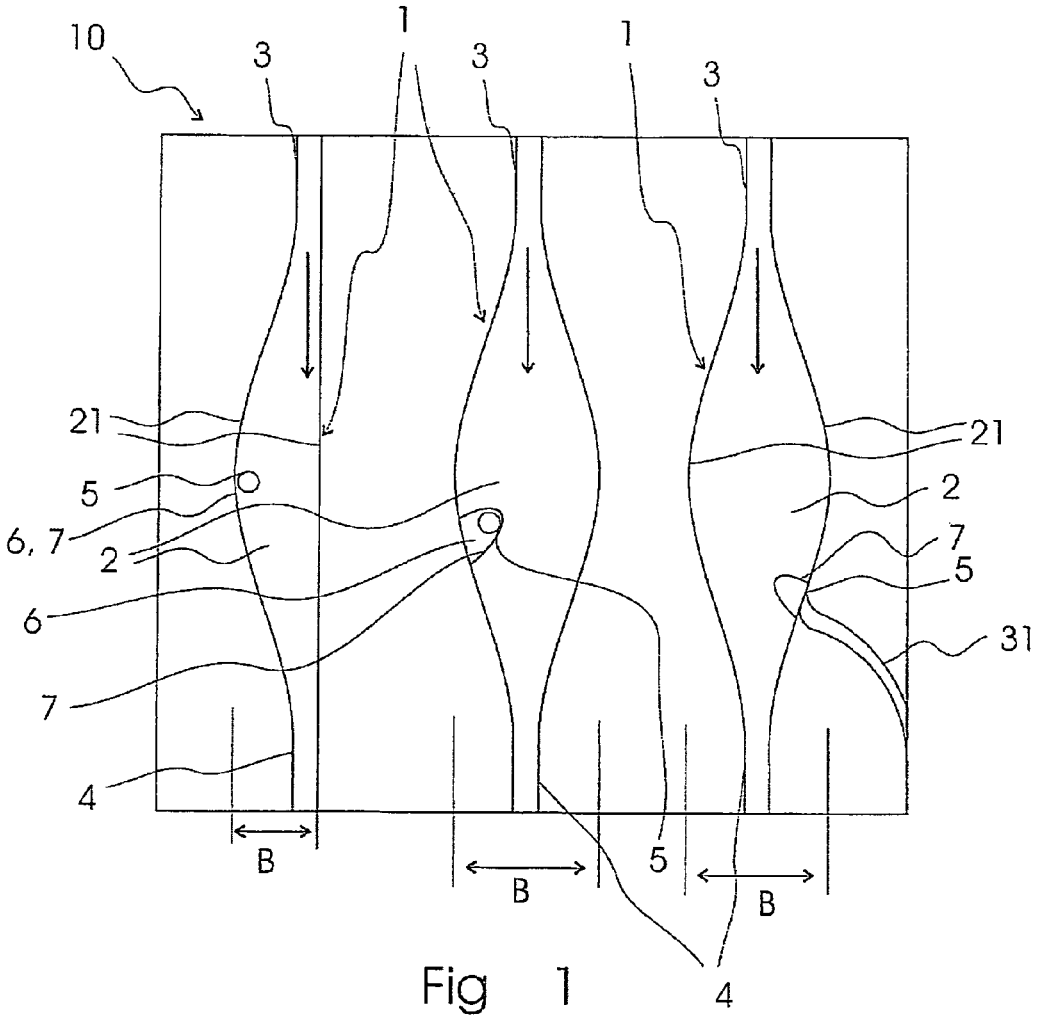
FIG. 1: Schematic representation of a microfluidic structure of the invention in top view with three alternative embodiments of the microfluidic structure.

In FIG. 1, three different embodiments of the microfluidic structure 1 of the invention are shown schematically. The structures such as fluid chamber 2, inlet line 3 and outlet line 4, as well as feed openings 5, are in this case formed as groovelike depressions and/or recesses in a base plate 10 and enclosed by a cover foil 11 (not visible in the figures, except for FIGS. 5*a* to 5*d*). The cross sections in the sample embodiment shown here have a rectangular shape transversely to the direction of flow, but in addition other cross sectional shapes such as semicircles are also possible.

In the first alternative embodiment of the microfluidic structure 1 of the invention, in FIG. 1, left, an asymmetrically shaped fluid chamber 2 is shown, being roughly in the shape of a circle segment in this sample embodiment. The feed opening 5 made in the base plate, as well as the holding position 6 for the second liquid volume 42, is situated in the region of the widening of the fluid chamber 2 near or already in contact with the side wall surface 21 of the fluid chamber, away from the shortest flow path through inlet channel 3, fluid chamber 2 and outlet channel 4, in order to prevent the second liquid volume 42 present in the fluid chamber 2 from being entrained by a gas flow.

Thanks to the proximity of the feed opening 5 and/or holding position 6 to the side wall surface 21 of the fluid chamber 2, the second liquid volume 42 can form a larger contact area with the curved wall surface 21 of the fluid chamber 2 as a holding structure 7 and thereby be held more securely at the holding position 6.

In the second, middle, sample embodiment of FIG. 1, a symmetrically shaped fluid chamber 2 is shown; the feed opening 5 here as well lies underneath the fluid chamber 2 in the base plate 10, not in the region of the side wall surface 21 of the fluid chamber 2, but rather between a central streamline and the side wall surface 21 of the fluid chamber 2. The holding position 6 in this instance has a holding structure 7 in the form of a depression 72 in the base plate 10.

In the third sample embodiment, shown at right in FIG. 1, an additional channel 31 empties into the fluid chamber 2 across a narrowed feed opening 5. By this channel 31, a second liquid volume 42 is placed in the fluid chamber 2. The channel 31 in this case can be supplied with the second liquid volume 42 by an operator device. Here as well, a holding structure 7 in the form of a depression in the base plate is provided in the region of the holding position 6.

Figure 2A:
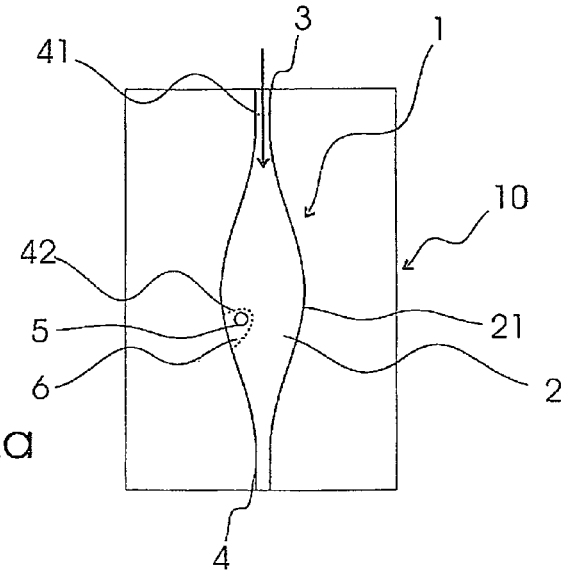
FIGS. 2*a* to 2*c*: Schematic representation of the process of combining of liquid volumes in a microfluidic structure of the invention.
Figure 2B:
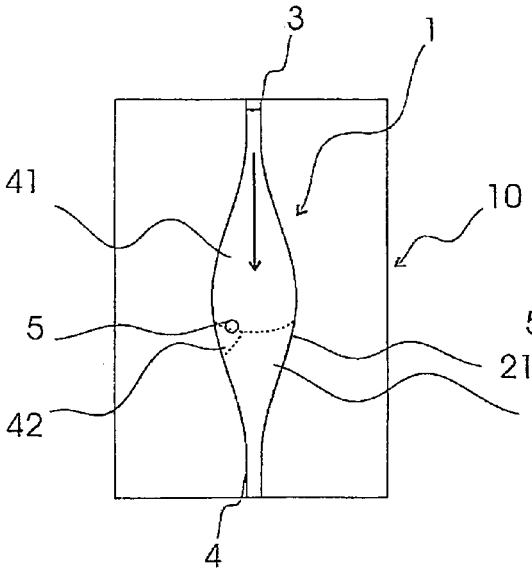
Figure 2C:
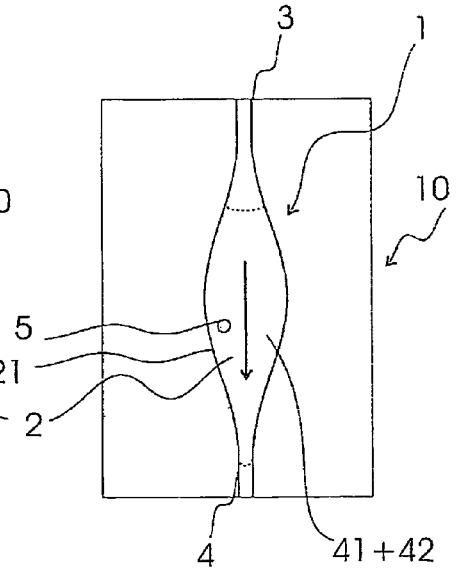

In operation, a second fluid volume 42 is first placed at the holding position 6 through the feed opening 5 in the microfluidic structure 1 of the invention, as shown in FIGS. 2*a* to 2*c*. Next, a first liquid volume 41 is placed in the fluid chamber 2 via the inlet channel 3 and propelled by a pressure difference in the direction of the outlet channel 4. As the first liquid volume 41 is driven by pressure through the fluid chamber 2, the first liquid volume 41 is broadened out to the full cross section of the fluid chamber, thanks to the wettable surfaces in this case, and coalesces without gas inclusions with the second liquid volume 42 already present in the fluid chamber 2. The combined fluid volume 41+42 finally gets into the outlet channel 4.

Figure 3:
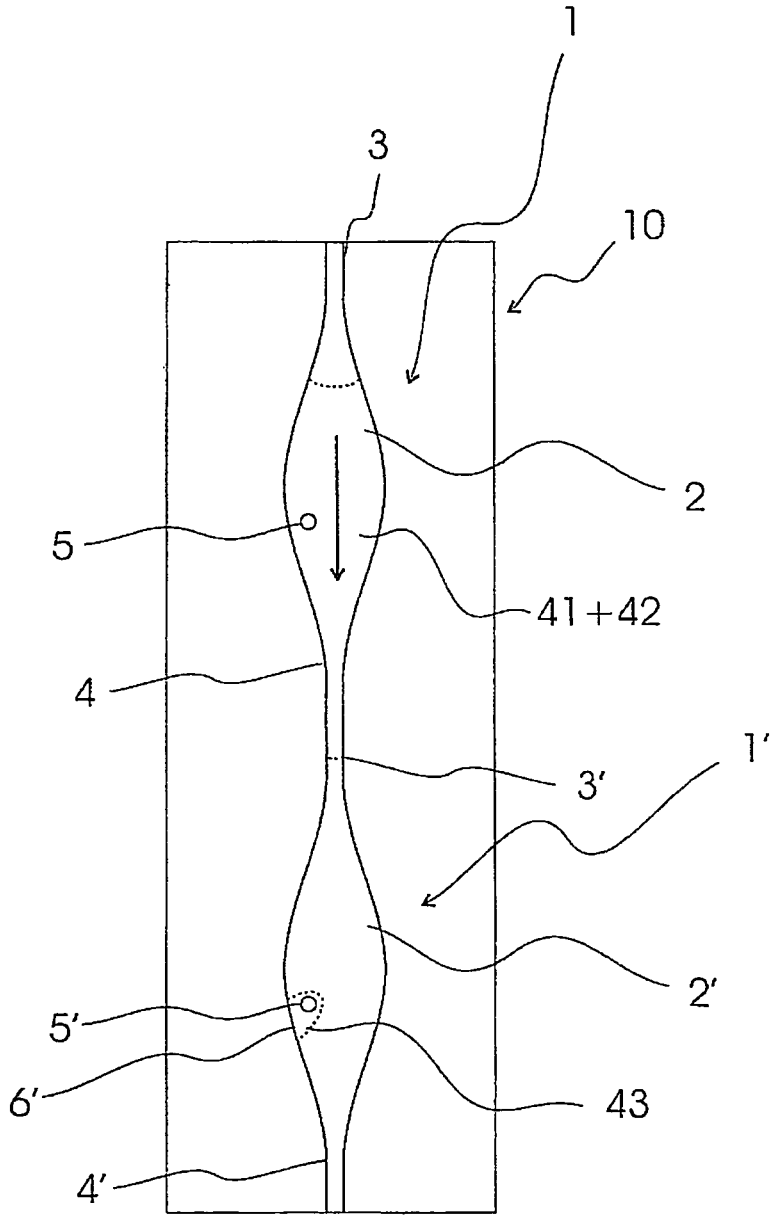
FIG. 3: Schematic representation of the consecutive sequence of two microfluidic structures of the invention in top view.

In FIG. 3, a consecutive sequence of two microfluidic structures 1, 1' of the invention is shown. In fluid chamber 2 of the first microfluidic structure 1 of the invention, a first liquid volume 41 was already combined with a second liquid volume 42. During the further passage of the combined liquid volumes 41+42 through the second microfluidic structure 1' of the invention, a third liquid volume 43 placed therein at a holding position 6' is likewise taken up in the liquid volume.

Figure 4:
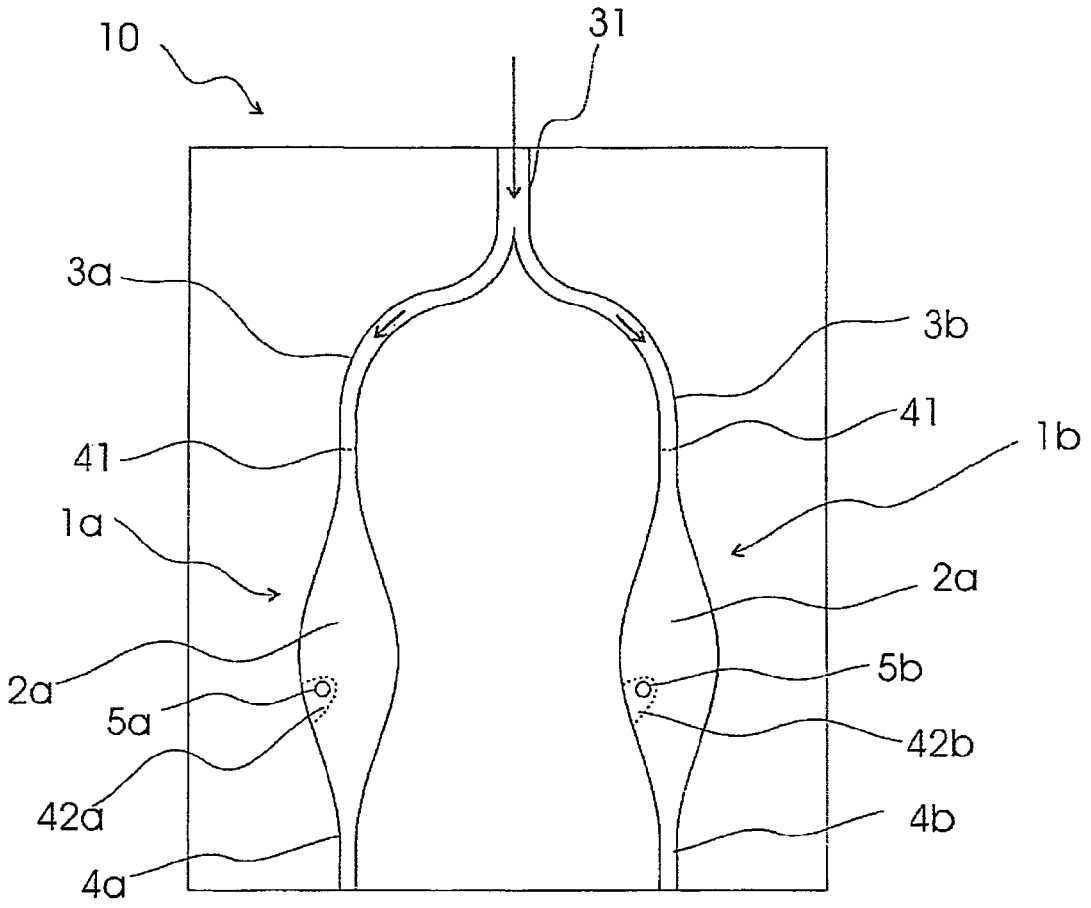
FIG. 4: Schematic representation of the parallel arrangement of two microfluidic structures of the invention in top view.

In FIG. 4 a parallel arrangement of two microfluidic structures 1*a*, 1*b* of the invention is shown, wherein the two inlet channels 3*a*, 3*b* are supplied by a dividing channel 31. In this case, a first liquid volume 41 can be combined each time with two different liquid volumes. In a microfluidic system with such a structure, the two combined liquid volumes can then be processed separately from each other.

In FIGS. 5*a* to 5*d*, the microfluidic structure 1 of the invention is shown in cross section at the height of the fluid chamber 2 with feed opening 5. The microfluidic structure 1 is formed by a base plate 10 with depressions made therein and a cover foil 11.

Figure 5A:
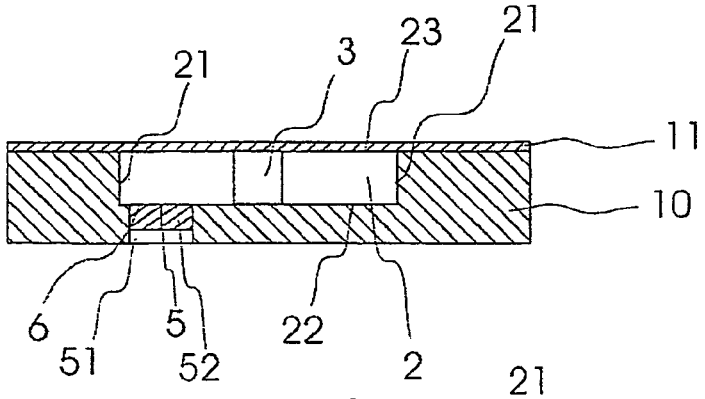
FIGS. 5*a* to 5*d*: Representation of the cross section of three microfluidic structures according to the invention.

In FIG. 5*a*, the feed opening 5 is fashioned in the base plate 10 underneath the fluid chamber 2. In the region of the feed opening 5, the base plate 10 has a recess 51 coming from underneath. In the region of the recess 51, a septum 52 is arranged, so that after adding the second liquid volume with a syringe, an automatic closing seal of the feed opening 5 is achieved by the septum 52, being also resistant to rather large pressures in the fluid chamber 2.

Figure 5B:
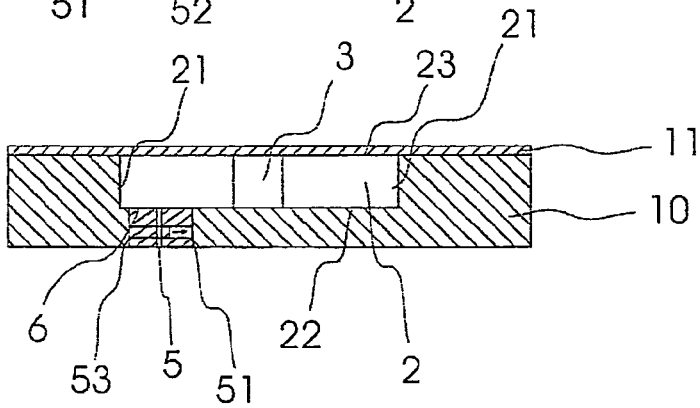

In FIG. 5*b* a feed opening 5 is shown in the base plate 10, which is opened and closed again by a movable sealing element 53. The sealing element 53 is driven by an actuator in the operator device.

Figure 5C:
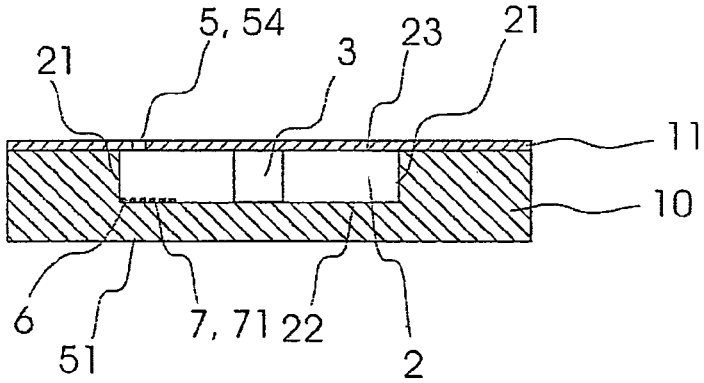

In FIG. 5*c* the feed opening 5 is formed by an opening 54 in the cover foil 11. The opening 54 in this case can also be formed only by a syringe tip when placing the second liquid volume 42 in the fluid chamber 2. When elastic foils are used as the cover foil 1, a self closure of the opening 54 occurs once more after the puncture. In the base plate 10, holding structures 7 in the form of several short steles 71 are arranged in the region of the holding position 6 for the second liquid volume 42.

Figure 5D:
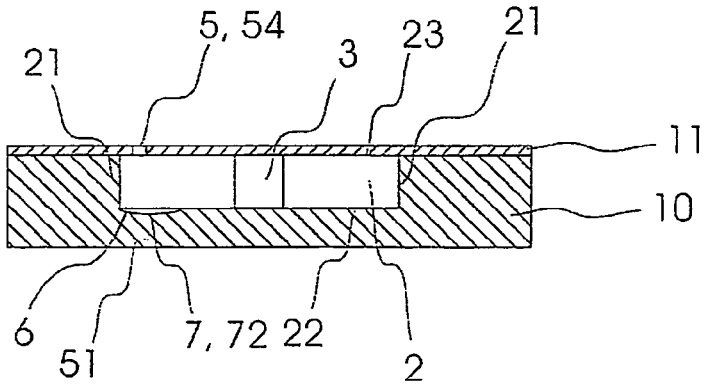

Also in FIG. 5*d* the feed opening 5 is formed by an opening 54 in the cover foil 11. In the base plate 10 there is arranged a holding structure 7 in the form of a recess 72 in the region of the holding position 6 for the second liquid volume 42.

Figure 6:
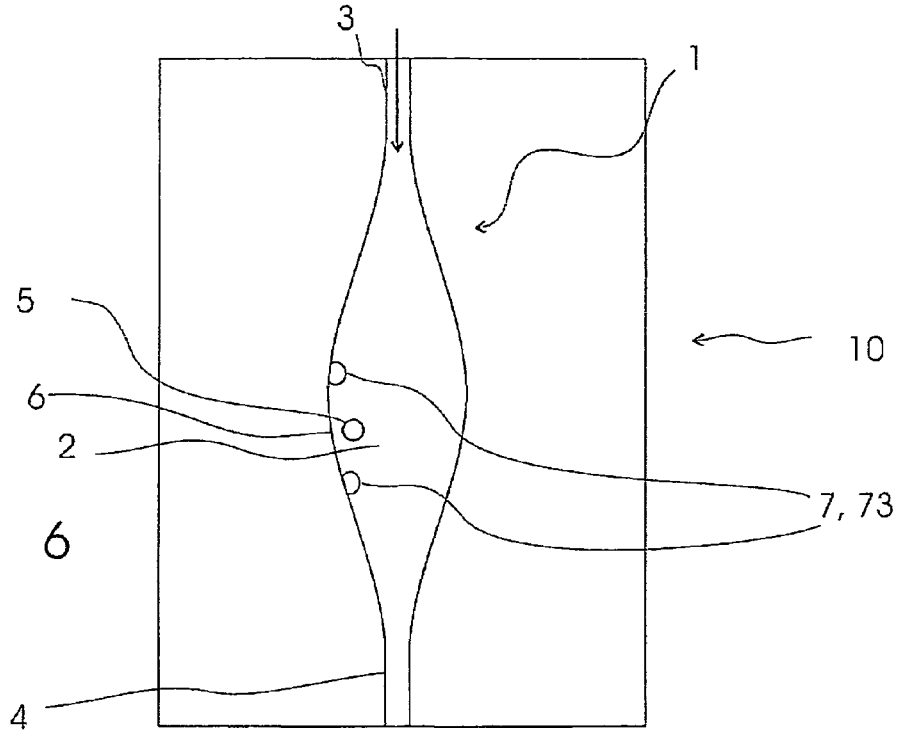
FIG. 6: Schematic representation of a microfluidic structure of the invention in top view with holding structures in the region of the holding positions in top view.

In FIG. 6, in the region of the feed opening 5 for the second liquid volume 42 in the fluid chamber 2, two steles 73 extending from the base plate 10 to the cover foil 11 are configured as holding structures 7 in the region of the holding position 6. In this case, a second liquid volume 42 applied via the feed opening 5 is held between the side wall 21, bottom 22 and top 23 surfaces of the fluid chamber 2 and the surfaces of the steles 73. Alternatively to this, other surface structures which heighten the contact area between the second liquid volume 42 and the fluid chamber 2 can also be placed in the region of the holding position 6 for the second liquid volume 42.

Figure 7:
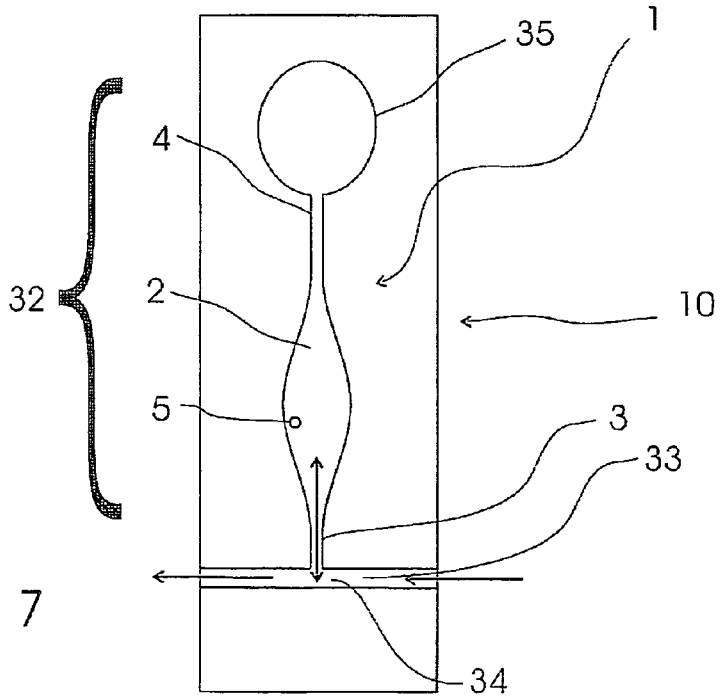
FIG. 7: Schematic representation of a microfluidic structure of the invention in the region of a dead-end channel in top view.

In FIG. 7, a microfluidic structure 1 according to the invention is shown in the region of a dead-end channel 32 of a lab-on-a-chip. In operation, a first liquid volume 41 is propelled by a pressure difference in a main channel 33. As soon as the first liquid volume 41 has arrived in the region of the intersection 34 of the main 33 and the dead-end channel 32, a pressure is built up in the main channel 33 in the flow direction in front of the first liquid volume 41, without diminishing the pressure acting in the flow direction behind the first liquid volume 41. Since a compressible fluid such as a gas or air is enclosed at the dead end of the blind channel 32 in a large-volume reservoir 35, the first liquid volume 41 advances into the dead-end channel 32 and is driven further in the dead-end channel 32 from the microfluidic structure 1 of the invention by further coordinated raising of the two pressures in the main channel 33, whereupon a second liquid volume 42 kept on hand in a fluid chamber 2 in the dead-end channel 32 is combined with the first liquid volume 41. By subsequent lowering of the pressures in the main channel 33, the combined liquid volumes 41+42 is again driven out from the dead-end channel 32 into the main channel 33 and further onward.

Figure 8:
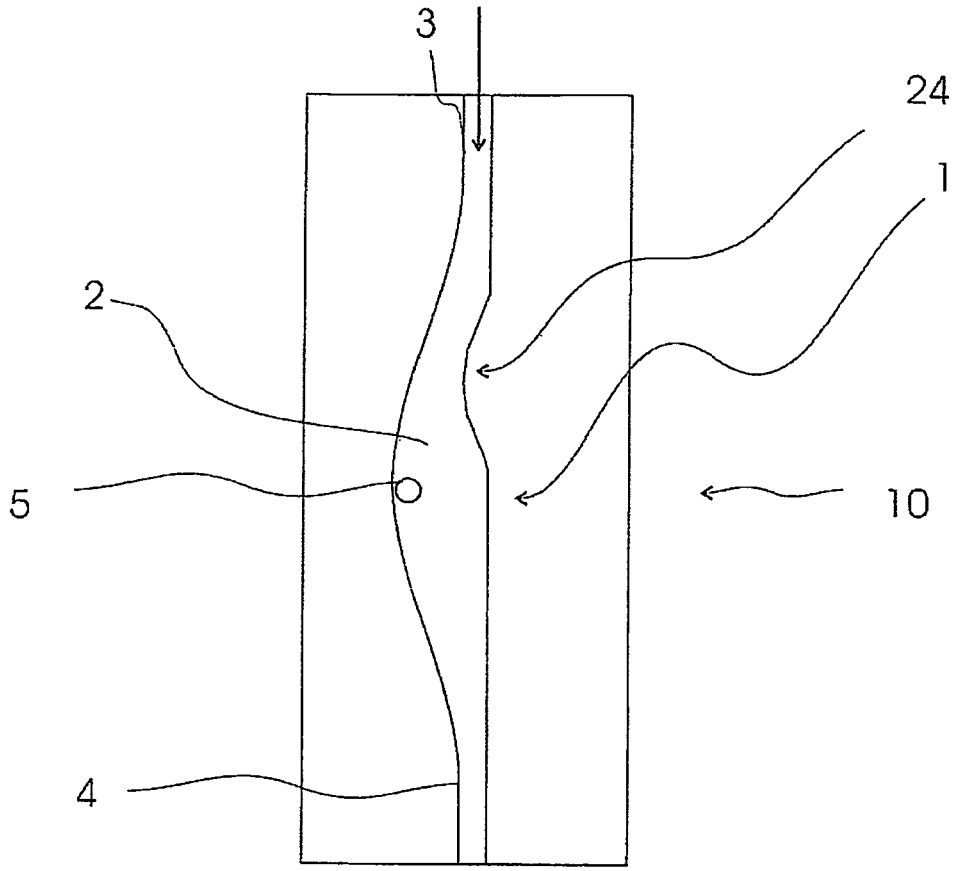
FIG. 8: Schematic representation of a microfluidic structure of the invention with a structure promoting the combining of liquid volumes in top view.

In FIG. 8 is shown a sample embodiment of the microfluidic structure 1 of the invention with a structure supporting the combining of the liquid volumes. The fluid chamber 2 in this case has an indentation 24 of the side wall surface 21 of the fluid chamber 2 protruding into the asymmetrically shaped fluid chamber 2 in the region of the emptying of the inlet channel 3 into the fluid chamber 2. Thanks to this structure 24, the first liquid volume 41 advancing into the fluid chamber 2 is forced in the direction of the side wall surface 21 lying opposite the indentation 24, so that a broadening of the first liquid volume 41 over the entire cross section of the fluid chamber is encouraged by wetting of all side surfaces 21 of the fluid chamber.

Figure 9:
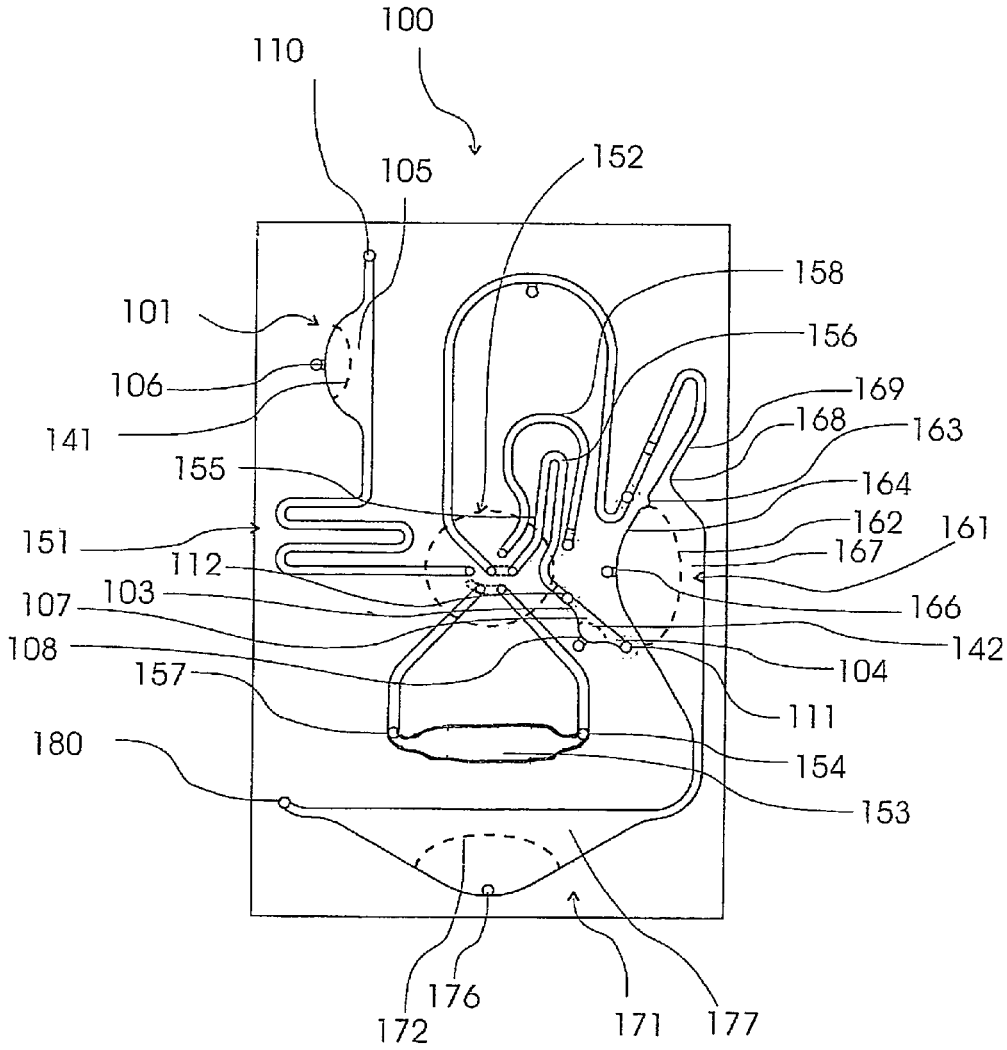
FIG. 9: Lab-on-a-chip/microfluidic system for carrying out a PCR reaction in top view.

FIG. 9 shows a lab-on-a-chip 100 to carry out a PCR reaction, in top view, containing among other things the microfluidic structure of the invention 101, 102, 161, 171 in multiple arrangement and different configurations.

During the operation of the lab-on-a-chip 100, a lysed sample is added to the chip 100 by an opening 110 in the lab-on-a-chip 100 by syringe pump (not shown) and combined in a first microfluidic structure 101 of the invention with a liquid mixture 141 stored in the fluid chamber 105, containing reagents for a reverse transcription/prePCR. In a meandering microfluidic channel 151 arranged thereafter in the flow direction, complete mixing of the sample with the liquid mixture 141 occurs. The resulting mixture is then delivered into the PCR chamber 153 by a fluidic connection that is opened up by a turning valve 152 (circular broken line).

The correct positioning of the mixture precisely in the PCR chamber is monitored by light barriers 154, 157, which depending on the level of filling of the channels at the end of the PCR chamber 153 let through a light signal directly onto a detector (not shown) or totally reflect the light signal. The further delivery of the sample by syringe pump stops once a signal change is detected at the light barrier 154, thereby confirming the complete filling of the PCR chamber 153. Next, the PCR chamber 153 is fluidically isolated from the other channels in the chip 100 by the turning valve 152 and the pre-amplification reaction occurs under cyclically occurring temperature regimes. The heating is done by heating clips placed in the operator device, which are placed against the PCR chamber 153 during operation. After this, a fluidic connection between the PCR chamber 153 and another channel 155 on the chip with an additional meandering microfluidic channel 156 for the mixing as well as an additional microfluidic structure 102 of the invention for the combining of two liquid volumes is opened up by the turning valve 152. This microfluidic structure 102 of the invention for the combining of two liquid volumes has at the outlet channel 104 an exit opening 111 to the outside, closed with a hydrophobic or nonwettable membrane. At this opening 111, a partial vacuum can be applied by an operator device (not part of the figure), enabling a pressure-driven delivery of the amplified sample solution into this structure 102. As soon as a liquid is present at the gas-permeable and liquid-impervious membrane in the opening 111, the delivery is halted by a measured pressure rise. An oligonucleotide mixture 142 previously stored in this microfluidic structure 102 of the invention via a feed opening is combined with the amplified sample solution. In a further process step, an excess pressure is applied via an operator device at a second opening 112 to the outside situated on the inlet channel 103, being likewise closed by a hydrophobic or nonwettable semipermeable membrane. The entire solution present in the microfluidic structure 102 is in this way separated from an excess outside the microfluidic structure 102. The excess is taken by the excess pressure and a corresponding switching of the turning valve 152 through a channel 158 to a waste channel on the lab-on-a-chip (not shown here). The liquid sample still present and now measured out in the structure 102 is delivered by an excess pressure applied at the opening 111 on the outlet channel 104 and a corresponding switching of the turning valve 152 once again into the PCR chamber 153. In this instance as well, the correct filling of the PCR chamber 153 is recognized and controlled by a light barrier 157. After repeated cyclical temperature runs in the PCR chamber 153, the amplified sample solution is combined with the requisite dilution buffer solutions 162, 172 via two additional microfluidic structures 161, 171 of the invention for the combining of two liquid volumes and taken onward through an outlet opening 180 from the lab-on-a-chip 100 into a detection device (not shown).

Due to the rather large liquid volumes being combined in the first structure 161, the first microfluidic structure 161 in the flow direction has holding structures 163 in the region of the holding position 164 for the first dilution buffer stored in the fluid chamber 167. The holding structures 163 in this case are formed by small indentations 165, 166 in the fluid chamber 167 at the start of the holding position 164. Furthermore, this first microfluidic structure 161 has a narrowing of the cross section at one end 168 where the inlet channel 169 passes into the fluid chamber 168, which supports an expansion of the sample solution as it is delivered into the fluid chamber 168.

The fluid chambers 107, 105, 167, 177 in this lab-on-a-chip 100 are asymmetrically shaped in the flow direction, while the feed openings 106, 108, 166, 176 and holding positions 164 are arranged in the region of the one-ended indentation of the fluid chambers 107, 105, 167, 177, away from the central streamline from the inlet 169, 103 to the outlet 104 channel through the fluid chamber 107, 105, 167, 177.

The channels contained in the lab-on-a-chip 100 can be joined together in various ways, for example, by a turning valve, as described in the German application DE 102008002674.3, so that various flow paths can be produced by switching. The openings of the channels being joined are sealed off from a chip surface by a valve body (not shown, the bearing surface is indicated by circular broken line). The valve body has recesses which are suitable for joining together various of the openings of the channels of the lab-on-a-chip.

LIST OF REFERENCE NUMBERS

1, 1' 1*a*, 1*b*, 101, 102, 161, 171 microfluidic structure
2, 2', 2*a*, 2*b*, 105, 167, 177, 107 fluid chamber
3, 3', 3*a*, 3*b*, 103, 169 inlet channel
4, 4', 4*a*, 4*b*, 104 outlet channel
5, 5', 5*a*, 5*b*, 106, 108, 176, 166 feed opening
6, 164 holding position
7, 163 holding structures
10 base plate
11 cover foil
21 side wall surface
22 bottom surface
23 top surface
24, 165, 168 indentation
25 largest cross sectional area of the fluid chamber
31, 155, 158 channel
32 dead-end channel
33 main channel
34 intersection
35 reservoir
41 first liquid volume
42, 42*a*, 42*b* second liquid volume
43 third liquid volume
51 recess
52 septum
53 movable sealing element
54 opening
71 short steles
72 depression
73 steles
100 Lab-on-a-chip or microfluidic system
110, 111, 112 opening
121 excess
141 liquid mixture reverse transcription/pre-PCR
151, 156 meandering microfluidic channel
152 turning valve
153 PCR chamber
154, 157 light barrier
162, 172 dilution buffer solutions
168 cross section narrowing
180 outlet opening
B largest width of cross section of fluid chamber in flow direction

What is claimed is:

1. A pressure-operable microfluidic structure for the bubble-free combining of two liquid volumes, comprising:

a fluid chamber, which has a feed opening, as well as an inlet and outlet channel emerging into the fluid chamber, wherein at least surfaces of the fluid chamber and the inlet channel are wettable and a contact angle between a first liquid and the surface of the fluid chamber and between the first liquid and the surface of the inlet channel are each 5° to 70°, wherein the fluid chamber has a cross section that widens out relative to the inlet channel in a direction of flow from the inlet to the outlet channel, wherein the widening of the inlet channel to a largest cross section of the fluid chamber in the flow direction is constant, and is configured to widen a first liquid volume that is essentially pressure-driven and conducted through the inlet channel and through the fluid chamber to a cross section at least approximately corresponding to the full cross section of the fluid chamber, wherein the fluid chamber comprises holding structures at only a portion of a cross section of the fluid chamber;

wherein only this portion of the cross-section constitutes a holding position; wherein the feed opening and/or holding position are arranged away from a central streamline extending from the inlet channel through the fluid chamber to the outlet channel; and wherein said holding structures are in the form of one of a) steles on either side of the feed opening, b) the fluid chamber being lower and in a form of a depression in the region of the holding position, and c) a surface roughness of the wall of the fluid chamber in the region of the holding position, and wherein the fluid chamber is configured such that a second liquid volume, placed in the fluid chamber through the feed opening, is configured to be held in the region of the holding position and wherein the second liquid volume when the first liquid volume is moved through by pressure can be taken up by the latter and delivered as a combined liquid volume through the fluid chamber and into the outlet channel.

2. The microfluidic structure according to claim 1, wherein the fluid chamber has a largest cross section widened with respect to the inlet channel by not more than 5 times.

3. The microfluidic structure according to claim 1, wherein the feed opening can be closed.

4. The microfluidic structure according to claim 3, wherein the feed opening is designed so that it closes automatically by placing a septum or an elastic cover foil on it.

5. The microfluidic structure according to claim 1, wherein an aperture of the feed opening is smaller than 1/20 of the largest cross sectional area of the fluid chamber.

6. The microfluidic structure according to claim 1, wherein the fluid chamber has several feed openings.

7. The microfluidic structure according to claim 1, wherein several fluid chambers are arranged one behind another.

8. The microfluidic structure according to claim 1, wherein the holding position occupies only a portion of the fluid chamber's cross section.

9. The microfluidic structure according to claim 1, wherein the holding structures reliably hold the second liquid volume by formation of a larger surface in the region of the holding position and/or creation of greater adhesion in the region of the holding position by surface modification.

10. The microfluidic structure according to claim 1, wherein the fluid chamber is widened only at one end in the flow direction and/or is asymmetrically shaped to form the holding position in the widening.

11. The microfluidic structure according to claim 1, wherein the feed opening can be opened and closed by an operator device.

12. A lab-on-a-chip comprising at least one microfluidic structure according to claim 1, wherein the lab-on-chip additionally has several other channels, chambers and/or reservoirs.

13. The lab-on-a-chip according to claim 12, wherein at least one chamber and/or reservoir is filled already with chemicals during the course of its manufacture.

14. The lab-on-a-chip according to claim 12, wherein the lab-on-a-chip has the microfluidic structures of the invention at least twice in consecutive or parallel arrangement in the direction of flow of the fluids.

15. The microfluidic structure according to claim 2, wherein the fluid chamber has a largest cross section widened with respect to the inlet channel by not more than 2.5 times.

16. The microfluidic structure according to claim 5, wherein the aperture of the feed opening is smaller than 1/100 of the largest cross sectional area of the fluid chamber.

17. A pressure-operable microfluidic structure for the bubble-free combining of two liquid volumes, comprising:

a fluid chamber, which has a feed opening, as well as an inlet and outlet channel emerging into the fluid chamber, wherein the fluid chamber has a cross section that widens out relative to the inlet channel in a direction of flow from the inlet to the outlet channel, wherein the widening of the inlet channel to a largest cross section of the fluid chamber in the flow direction is constant and is configured to widen a first liquid volume that is essentially pressure-driven and conducted through the inlet channel and through the fluid chamber to a cross section at least approximately corresponding to the full cross section of the fluid chamber, wherein the fluid chamber comprises a holding position formed by at least one at least partly curved or at least partly trough-shaped wall, bottom or top surface, thereby forming holding structures disposed within only a portion of a cross section of the fluid chamber; wherein the feed opening and/or holding position are arranged away from a central streamline extending from the inlet channel through the fluid chamber to the outlet channel; and wherein the fluid chamber is configured such that a second liquid volume, placed in the fluid chamber through the feed opening, is configured to be held in the region of the holding position and wherein the second liquid volume when the first liquid volume is moved through by pressure can be taken up by the latter and delivered as a combined liquid volume through the fluid chamber and into the outlet channel.

18. A pressure-operable microfluidic structure for the bubble-free combining of two liquid volumes, comprising:

a fluid chamber, which has a feed opening, as well as an inlet and outlet channel emerging into the fluid chamber, wherein the fluid chamber has a cross section that widens out relative to the inlet channel in a direction of flow from the inlet to the outlet channel, wherein the widening of the inlet channel to a largest cross section of the fluid chamber in the flow direction is curvelike without edges or corners, and is configured to widen a first liquid volume that is essentially pressure-driven and conducted through the inlet channel and through the fluid chamber to a cross section at least approximately corresponding to the full cross section of the fluid chamber, wherein the fluid chamber comprises holding structures at only a portion of a cross section of the fluid chamber; wherein only this portion of the cross-section constitutes a holding position; wherein the feed opening and/or holding position are arranged away from a central streamline extending from the inlet channel through the fluid chamber to the outlet channel; and wherein the fluid chamber is configured such that a second liquid volume, placed in the fluid chamber through the feed opening, is configured to be held in the region of the holding position and wherein the second liquid volume when the first liquid volume is moved through by pressure can be taken up by the latter and delivered as a combined liquid volume through the fluid chamber and into the outlet channel.

* * * * *